US010131511B2

(12) United States Patent
Murodate et al.

(10) Patent No.: US 10,131,511 B2
(45) Date of Patent: Nov. 20, 2018

(54) SHEET CONVEYANCE APPARATUS

(71) Applicant: Brother Kogyo Kabushiki Kaisha, Nagoya-shi, Aichi-ken (JP)

(72) Inventors: Yusuke Murodate, Nagoya (JP); Takashi Ohama, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/408,781

(22) Filed: Jan. 18, 2017

(65) Prior Publication Data

US 2017/0203933 A1 Jul. 20, 2017

(30) Foreign Application Priority Data

Jan. 18, 2016 (JP) ..... 2016-007387

(51) Int. Cl.

| | |
|---|---|
| ***B65H 5/22*** | (2006.01) |
| ***B65H 5/06*** | (2006.01) |
| ***B65H 1/04*** | (2006.01) |
| ***B65H 31/00*** | (2006.01) |
| ***B65H 31/02*** | (2006.01) |

(52) U.S. Cl.

CPC ..... *B65H 5/062* (2013.01); *B65H 1/04* (2013.01); *B65H 31/00* (2013.01); *B65H 31/02* (2013.01); *B65H 2301/4212* (2013.01); *B65H 2405/1116* (2013.01); *B65H 2405/1124* (2013.01); *B65H 2405/11162* (2013.01); *B65H 2405/111646* (2013.01); *B65H 2405/3322* (2013.01); *B65H 2801/39* (2013.01)

(58) Field of Classification Search

CPC ..... B65H 2405/111646; B65H 2405/11162; B65H 2405/3322; B65H 2405/1142; B65H 2405/332; B65H 2405/11425; B65H 2405/1124

See application file for complete search history.

(56) References Cited

U.S. PATENT DOCUMENTS

| | | | |
|---|---|---|---|
| 5,897,113 | A | 4/1999 | Kondo et al. |
| 9,332,144 | B2 | 5/2016 | Kozaki et al. |

(Continued)

FOREIGN PATENT DOCUMENTS

| | | | |
|---|---|---|---|
| JP | H09-110273 | A | 4/1997 |
| JP | 2007-282034 | A | 10/2007 |
| JP | 5579587 | B2 | 8/2014 |

*Primary Examiner* — Howard J Sanders

(74) *Attorney, Agent, or Firm* — Banner & Witcoff, Ltd.

(57) ABSTRACT

A sheet conveyance apparatus includes: a supply-sheet supporter having a supply support surface that supports a sheet; a conveyor configured to convey the sheet from the supply-sheet supporter along a conveyance path; and a discharged-sheet supporter disposed above the supply-sheet supporter and configured to support the sheet conveyed by the conveyor. The discharged-sheet supporter includes: a particular end portion located farthest from the conveyor in the discharged-sheet supporter and opposed to the supply support surface from above; and a movable member including the particular end portion at one of opposite end portions of the movable member, which one is farther from the conveyor than another of the opposite end portions. The movable member is pivotable in a direction in which a distance between the particular end portion and the supply support surface is increased.

15 Claims, 9 Drawing Sheets

(56) References Cited

U.S. PATENT DOCUMENTS

| | | | | |
|---|---|---|---|---|
| 2007/0210512 | A1* | 9/2007 | Sakakibara | B65H 29/14 271/314 |
| 2009/0218749 | A1* | 9/2009 | Shingai | B65H 31/02 271/3.14 |
| 2009/0220290 | A1* | 9/2009 | Shingai | B65H 31/02 399/367 |
| 2012/0155941 | A1 | 6/2012 | Kozaki et al. | |
| 2016/0127590 | A1* | 5/2016 | Hatayama | B65H 5/06 358/498 |

* cited by examiner

SHEET CONVEYANCE APPARATUS

CROSS REFERENCE TO RELATED APPLICATION

The present application claims priority from Japanese Patent Application No. 2016-007387, which was filed on Jan. 18, 2016, the disclosure of which is herein incorporated by reference in its entirety.

BACKGROUND

The following disclosure relates to a sheet conveyance apparatus.

There is known a scanner unit as one example of a conventional sheet conveyance apparatus. The scanner unit includes: a main tray and a sub-tray as a supply-sheet supporter; a document conveying mechanism; and partition plates as a discharged-sheet supporter.

Upper surfaces of the main tray and the sub-tray support a document that is conveyed by the document conveying mechanism along a conveyance path. The partition plates are respectively connected to upper end portions of document guides provided on the main tray. The partition plates are provided above the main tray and respectively include opposed end portions. The opposed end portions are located at a downstream end portion of the conveyance path and opposed to the upper surface of the main tray from above, with a particular space between each of the opposed end portions and the upper surface of the main tray.

When setting a document onto the main tray and the sub-tray in this scanner unit, a user inserts the document in between the upper surface of the main tray and each of the opposed end portions of the respective partition plates. The document is then conveyed by the document conveying mechanism and discharged onto upper surfaces of the respective partition plates.

SUMMARY

Incidentally, the above-described conventional scanner unit can be made smaller in size in the up and down direction by reducing the distance between the upper surface of the main tray and each of the opposed end portions. The size reduction of the scanner unit however increases a risk of the document being caught by the opposed end portions when the user inserts the document in between the upper surface of the main tray and each of the opposed end portions of the respective partition plates. This makes it difficult to achieve both of (i) reduced size of the conventional scanner unit in the up and down direction and (ii) easy operation of setting the document onto the main tray and the sub-tray of the scanner unit.

Accordingly, an aspect of the disclosure relates to a sheet conveyance apparatus having a reduced size in an up and down direction and enabling a user to easily set a sheet onto a supply-sheet supporter.

In one aspect of the disclosure, a sheet conveyance apparatus including: a supply-sheet supporter having a supply support surface that supports a sheet; a conveyor configured to convey the sheet from the supply-sheet supporter along a conveyance path; and a discharged-sheet supporter disposed above the supply-sheet supporter and configured to support the sheet conveyed by the conveyor. The discharged-sheet supporter including: a particular end portion located farthest from the conveyor in the discharged-sheet supporter; and a movable member having the particular end portion at one of opposite end portions of the movable member, which one is farther from the conveyor than another of the opposite end portions, the particular end portion being movable so as to increase a distance between the particular end portion and the supply support surface.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Hereinafter, there will be described first and second embodiments by reference to the drawings.

First Embodiment

Figure 1:
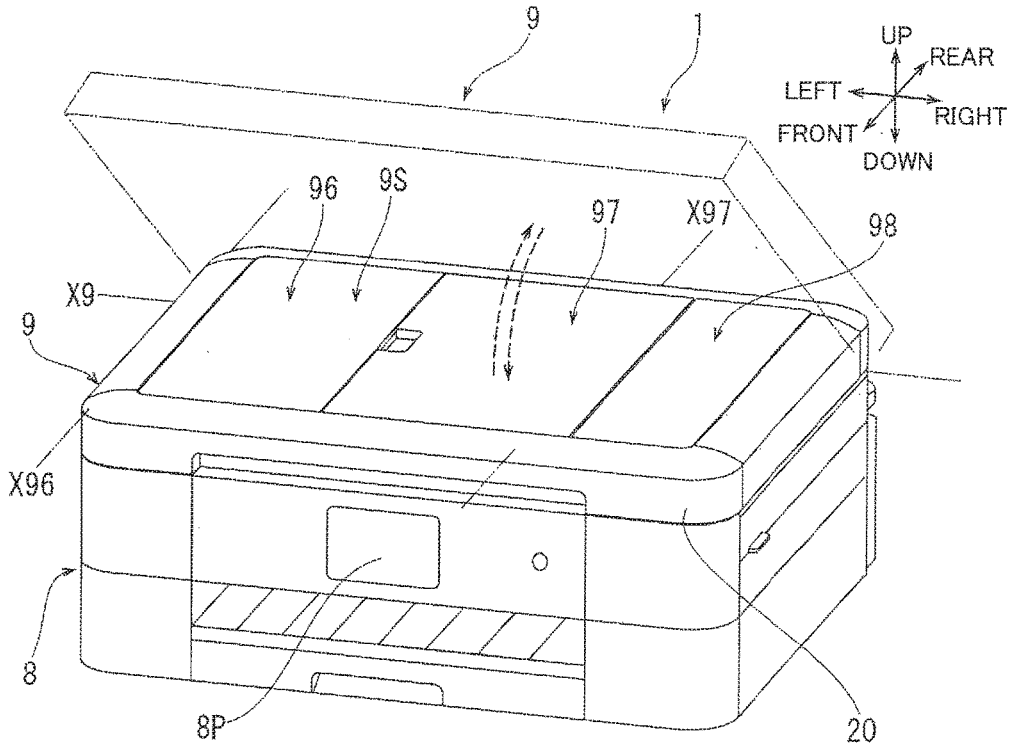
FIG. 1 is a perspective view of an image reading apparatus according to a first embodiment.

As illustrated in FIG. 1, an image reading apparatus 1 according to a first embodiment is one example of a sheet conveyance apparatus. In FIG. 1, a side of the image reading apparatus 1 on which an operation panel 8P is provided is defined as a front side, and the other sides and front, rear, left, right, up, and down directions are defined with respect to the image reading apparatus 1 viewed from a front side thereof.

Overall Construction

As illustrated in FIGS. 1-5, the image reading apparatus 1 includes a main body 8, an opening and closing member 9, an image forming unit 5, a reading unit 3, a conveyor 4, a supply-sheet supporter 91, and a discharged-sheet supporter 95 (as one example of a first discharged-sheet supporter). The main body 8 is shaped like a flat box. As illustrated in FIG. 1, a front surface of the main body 8 is provided with the operation panel 8P in the form of a touch screen, for example.

Figure 2:
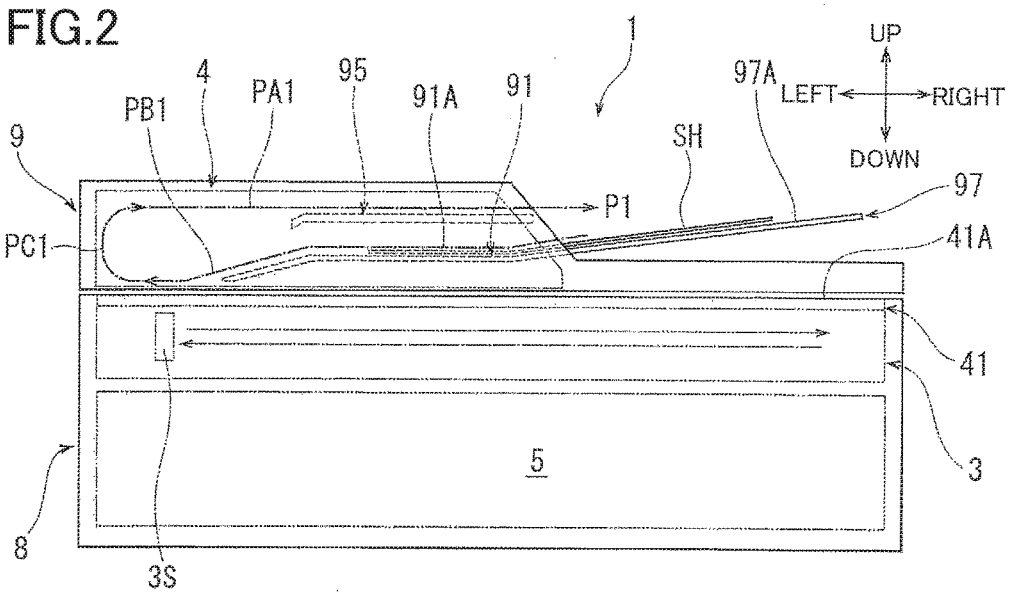
FIG. 2 is a schematic front elevational view of the image reading apparatus according to the first embodiment.

As illustrated in FIG. 2, the image forming unit 5 is provided in a lower portion of the main body 8. The image forming unit 5 performs ink-jet or laser recording to form an image on a sheet. The reading unit 3 is provided in an upper portion of the main body 8. The reading unit 3 reads an image formed on a document. As illustrated in FIGS. 2-5, the conveyor 4, the supply-sheet supporter 91, and the discharged-sheet supporter 95 are provided on the opening and closing member 9. As illustrated in FIGS. 2 and 4, the supply-sheet supporter 91 is capable of supporting a plurality of sheets SH. The conveyor 4 conveys each sheet SH from the supply-sheet supporter 91 along a conveyance path P1. The reading unit 3 reads an image formed on the conveyed sheet SH. After the image reading, the sheet SH is discharged onto the discharged-sheet supporter 95 by the conveyor 4.

As illustrated in FIG. 4, a first platen glass 41 and a second platen glass 42 are provided on an upper surface of the main body 8. An upper surface of the first platen glass 41 serves as a document support surface 41A. When the reading unit 3 reads an image formed on a stationary document, the document support surface 41A supports a lower surface of the document. Examples of the document include sheets, such as paper sheets and OHP sheets, and books. The second platen glass 42 is located at the left of the first platen glass 41 and elongated in the front and rear direction. An upper surface of the second platen glass 42 serves as a reading surface 42A. When the reading unit 3 reads the sheets SH conveyed one by one by the conveyor 4, the reading surface 42A supports and guides lower surfaces of the respective sheets SH.

In the present embodiment, an object for which image reading is performed using the document support surface 41A is referred to as "document", and an object for which image reading is performed using the conveyor 4 is referred to as "sheet SH". The document and the sheet SH may be substantially the same as each other.

As illustrated in FIG. 1, the opening and closing member 9 is supported by hinges, not illustrated, provided near an upper edge of a rear surface of the main body 8. The opening and closing member 9 is pivotable about an opening and closing axis X9 extending in the right and left direction. In a closed state illustrated in FIGS. 1-5, the opening and closing member 9 covers the document support surface 41A facing upward. As indicated by the two-dot chain lines in FIG. 1, the opening and closing member 9 is pivoted about the opening and closing axis X9 such that a front end portion of the opening and closing member 9 is moved upward and rearward. This pivotal movement exposes the document support surface 41A. This state allows a user to place a document to be read, onto the document support surface 41A.

As illustrated in FIG. 4, the reading unit 3 includes: a reading sensor 3S provided in the upper portion of the main body 8; and a scanning mechanism, not illustrated. The reading sensor 3S is one example of a reader. The scanning mechanism reciprocates the reading sensor 3S in the right and left direction in the main body 8 under the document support surface 41A and the reading surface 42A. When the reading sensor 3S reads an image formed on the document placed on the document support surface 41A, the reading sensor 3S reads the image while being moved under the document support surface 41A. The reading sensor 3S is stopped under the reading surface 42A at a stationary reading position. When the reading sensor 3S reads an image formed on the sheet SH conveyed by the conveyor 4, the reading sensor 3S is stopped at the stationary reading position. The reading sensor 3S is a well-known image reading sensor such as a contact image sensor (CIS) and a charge coupled device (CCD).

As illustrated in FIGS. 1 and 3-5, the opening and closing member 9 includes a body 20, a first cover 96, a second cover 97, and a third cover 98. As illustrated in FIG. 4, the opening and closing member 9 includes a guide member 70. As illustrated in FIGS. 3-9, the opening and closing member 9 includes guides 60, extending members 101, 102, and movable portions 110, 120 each as one example of a movable member.

Figure 3:
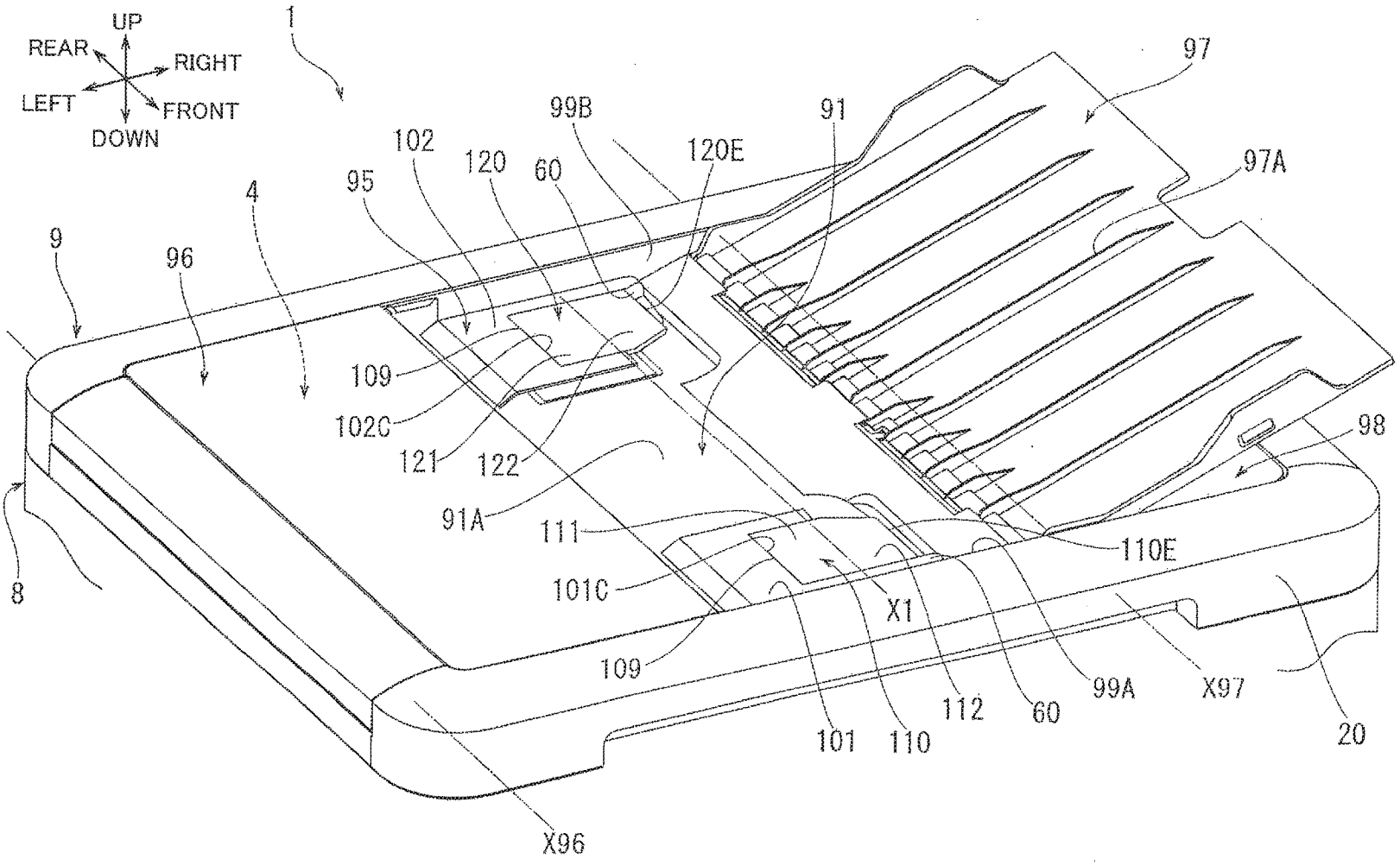
FIG. 3 is a partial perspective view of the image reading apparatus according to the first embodiment, illustrating a state in which a sub-tray is opened.
Figure 4:
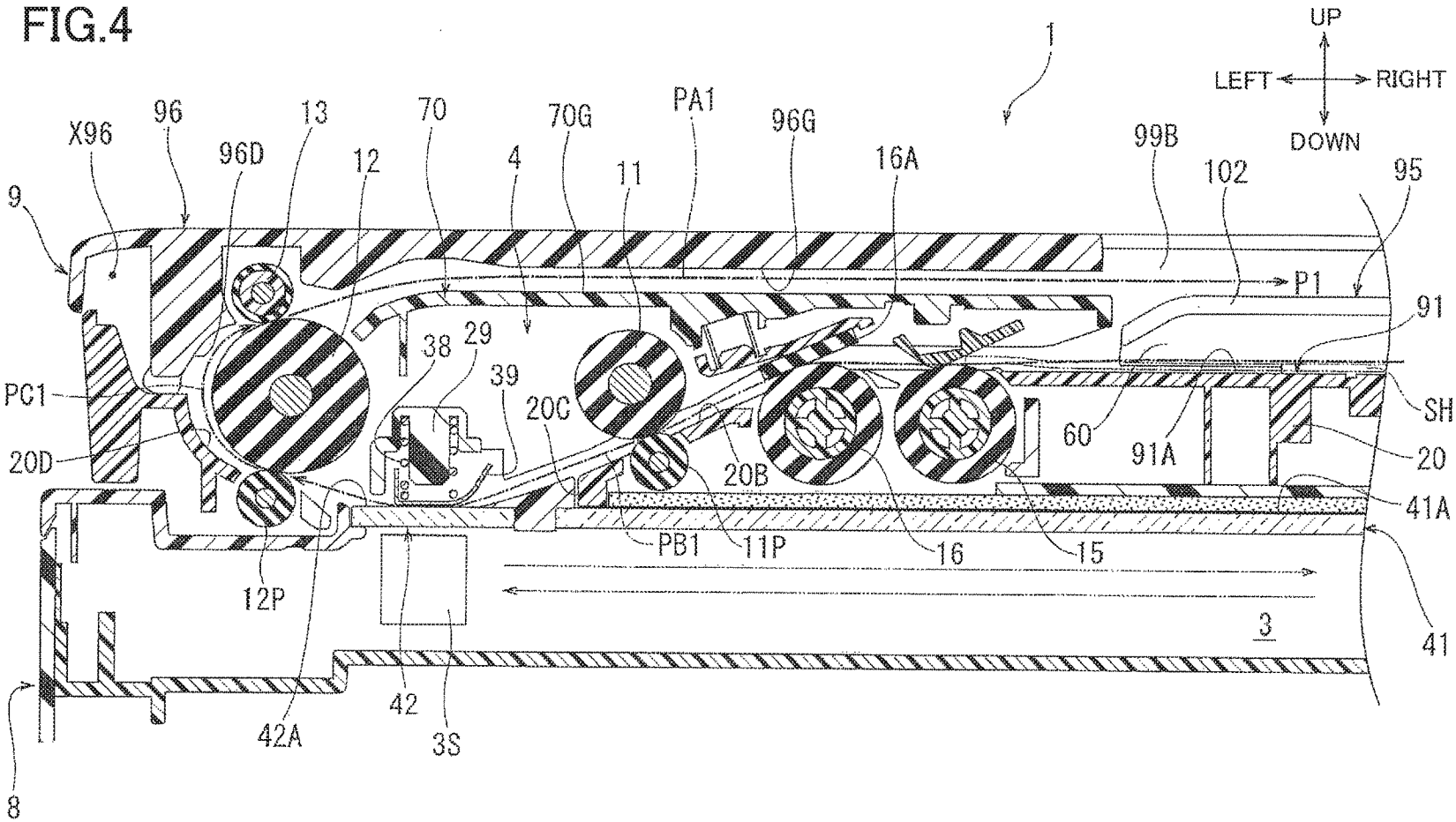
FIG. 4 is a partial cross-sectional view of the image reading apparatus according to the first embodiment.
Figure 5:
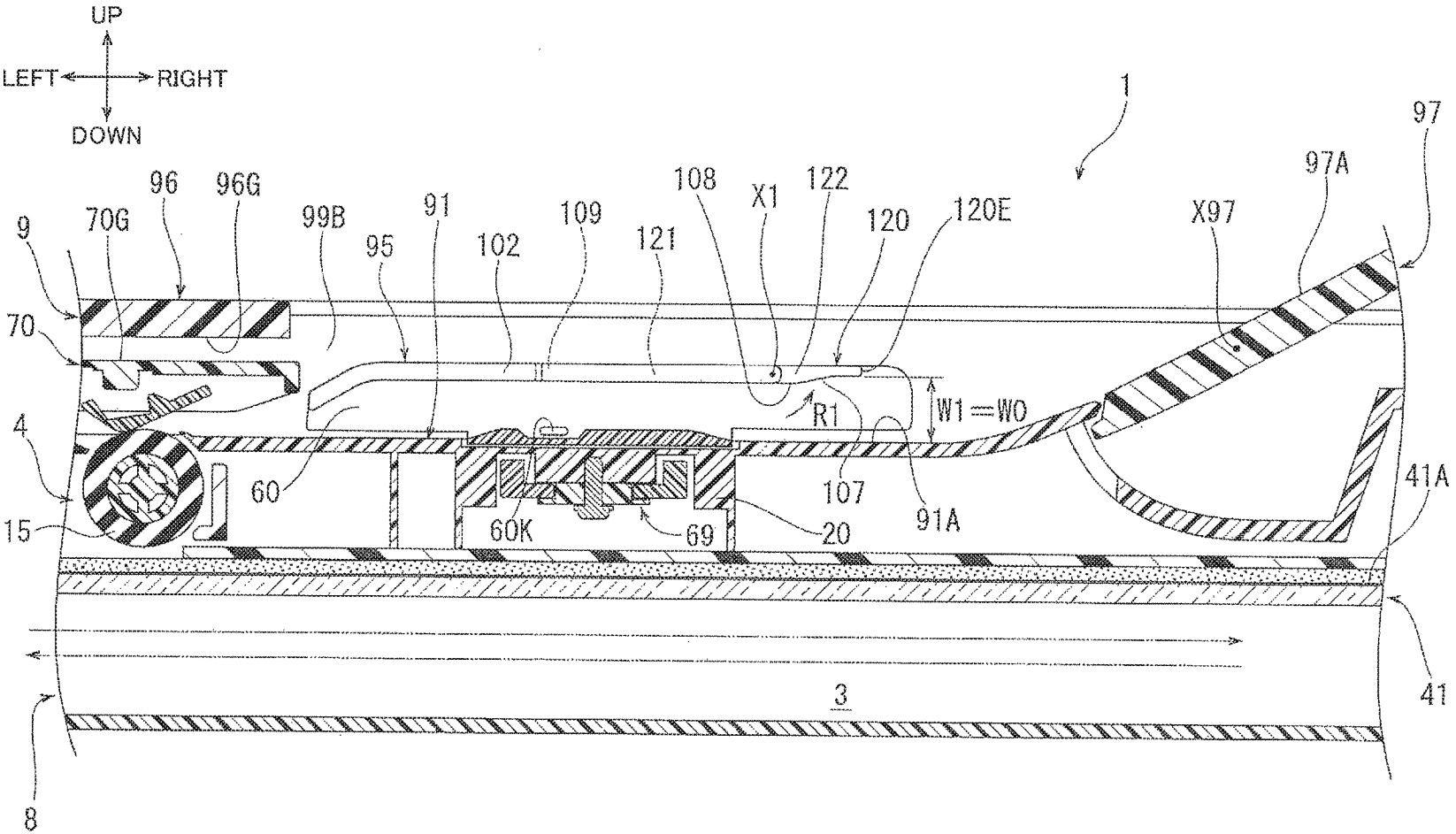
FIG. 5 is a partial cross-sectional view of the image reading apparatus according to the first embodiment.

As illustrated in FIGS. 3-5, the body 20 is constituted by a plurality of components combined with each other, such as a frame, a chute, and an exterior cover. The conveyor 4 is supported by the body 20.

As illustrated in FIGS. 1, 3, and 4, the first cover 96 is supported by the body 20 so as to be pivotable about an opening and closing axis X96 such that the first cover 96 is opened and closed. The opening and closing axis X96 is located at a left end portion of the opening and closing member 9 and extends in the front and rear direction. Illustration of an open state of the first cover 96 is omitted. As illustrated in FIGS. 1 and 3-5, the second cover 97 is supported by the body 20 so as to be pivotable about an opening and closing axis X97 such that the second cover 97 is opened and closed. The second cover 97 is one example of a second discharged-sheet supporter. The opening and closing axis X97 is located at a right portion of the opening and closing member 9 and extends in parallel with the opening and closing axis X96. A position at which the second cover 97 is closed as illustrated in FIG. 1 is a covering position. When located at the covering position, the second cover 97 covers an upper portion of the discharged-sheet supporter 95. A position at which the second cover 97 is open as illustrated in, e.g., FIGS. 3 and 5 is a support position. When located at the support position, the second cover 97 is spaced apart from and located to the right of the supply-sheet supporter 91 and the discharged-sheet supporter 95 and farther from the conveyor 4 than the supply-sheet supporter 91 and the discharged-sheet supporter 95. As illustrated in FIGS. 1 and 3, the third cover 98 is supported by the body 20 at a position located to the right of the opening and closing axis X97.

As illustrated in FIG. 1, the second cover 97 located at the covering position is located to the right of the first cover 96 so as to be contiguous thereto. The third cover 98 is contiguous to and located to the right of the second cover 97 located at the covering position. A flat exterior surface 9S is constituted by a surface of the first cover 96 which faces upward, a surface of the second cover 97 located at the covering position, which surface faces upward, and a surface of the third cover 98 which faces upward. The exterior surface 9S is located over a recessed central portion of the body 20 so as to cover the central portion. The exterior surface 9S continues to an outer frame portion of the body 20.

In the state in which the second cover 97 is located at the support position, as illustrated in FIGS. 3 and 5, a surface of the second cover 97 which is opposite to the second cover 97 from the exterior surface 9S faces upward so as to serve as a subsidiary support surface 97A. The subsidiary support surface 97A is not limited to a flat surface not having recessions and protrusions. The subsidiary support surface 97A may have any shape as long as the subsidiary support surface 97A is capable of substantially supporting the sheets SH. In the state in which the second cover 97 is located at the support position, the sheet SH to be conveyed to the conveyor 4 is supported by the subsidiary support surface 97A and a support surface 91A of the supply-sheet supporter 91. Also, the sheet SH discharged by the conveyor 4 is supported by the subsidiary support surface 97A, and the extending members 101, 102 and the movable portions 110, 120 of the discharged-sheet supporter 95.

In a state in which the first cover 96 is closed, as illustrated in FIG. 4, the first cover 96 is located over a guide surface 70G of the guide member 70 and a discharge roller 12 of the conveyor 4 so as to cover these components. Though not illustrated, when the first cover 96 is moved from the closed position to the open position, the first cover 96 is pivoted upward away from the discharge roller 12 to expose the guide surface 70G of the guide member 70 and the discharge roller 12. This state enables the user to perform maintenance of the conveyor 4 such as removal of the sheet SH jammed on the conveyance path P1.

A surface of the first cover 96 which is opposite to the first cover 96 from the exterior surface 9S serves as a cover guide surface 96G. The cover guide surface 96G is located over the guide surface 70G of the guide member 70 so as to face the guide surface 70G. The cover guide surface 96G is not limited to a flat surface not having recessions and protrusions. The cover guide surface 96G may have any shape as long as the cover guide surface 96G is capable of substantially supporting the sheets SH.

Figure 9:
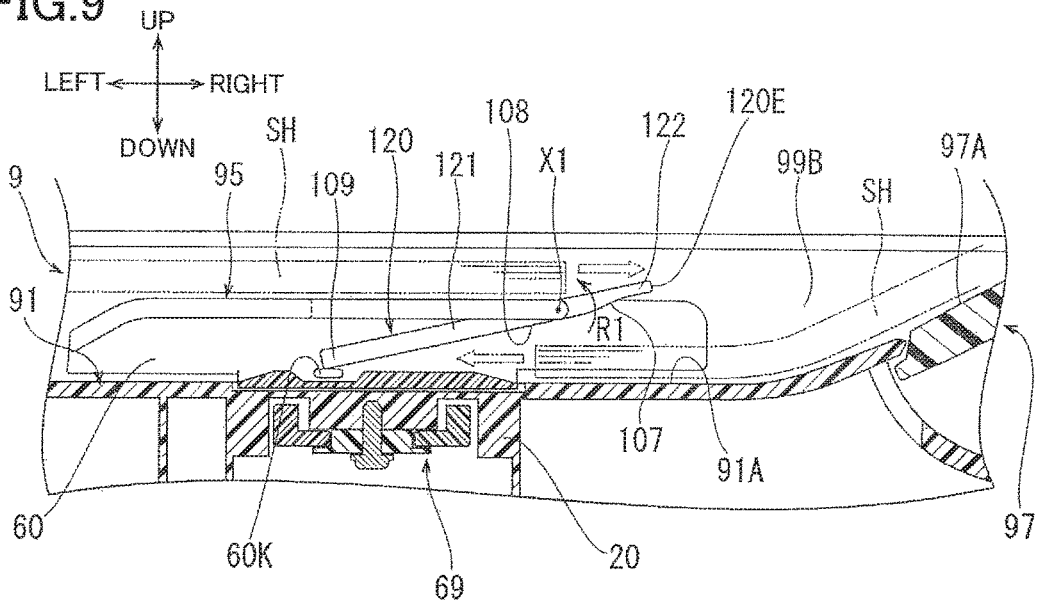
FIG. 9 is a partial cross-sectional view of the image reading apparatus according to the first embodiment, for explaining operations of the movable portion.

As illustrated in FIGS. 3-5, the support surface 91A is provided on the recessed central portion of the body 20. A right end of the support surface 91A is adjacent to one of opposite edges of the second cover 97 located at the support position, which one is nearer to the opening and closing axis X97 than the other. The support surface 91A extends leftward substantially horizontally in a direction away from the opening and closing axis X97. The support surface 91A is a portion of the supply-sheet supporter 91. As illustrated in FIGS. 2 and 9, the support surface 91A supports a lower surface of the sheet SH conveyed by the conveyor 4. Examples of the sheet SH include sheets and OHP sheets. In the present embodiment, the widthwise direction of the support surface 91A coincides with the front and rear direction.

As illustrated in FIG. 3, a pair of the guides 60 each as one example of a wall are provided on the support surface 91A. The guides 60 are respectively disposed on front and rear end portions of the support surface 91A. FIGS. 4-9 only illustrate the rear guide 60, with the front guide 60 located in front of the sheet surface of each of FIGS. 4-9. The front and rear guides 60 are mirror-image components having substantially the same construction, and illustration and explanation of the front guide 60 are partly omitted.

Each of the guides 60 is a wall protruding upward from the support surface 91A and extending in the right and left direction. The guides 60 are opposed to each other in the front and rear direction. The guides 60 are slidable in the front and rear direction on the support surface 91A. The guides 60 are coupled to each other by a rack-and-pinion mechanism 69 illustrated in FIG. 5. The guides 60 are moved toward and away from each other in the front and rear direction so as to be capable of holding the sheets SH of various sizes which are supported on the supply-sheet supporter 91. Thus, the guides 60 position the sheets SH on the supply-sheet supporter 91 with center alignment in the widthwise direction of the support surface 91A.

As illustrated in FIG. 3, the front extending member 101 is connected at its front end portion to an upper end portion of the front guide 60. The rear extending member 102 is connected at its rear end portion to an upper end portion of the rear guide 60. The extending members 101, 102 extend toward each other in the front and rear direction. The front extending member 101 and the rear extending member 102 are mirror-image components having substantially the same construction, and illustration and explanation of the front extending member 101 are partly omitted.

As illustrated in FIGS. 3 and 5-7, each of the extending members 101, 102 is spaced apart from the support surface 91A and shaped like a substantially planar plate extending in the front and rear direction. A left end portion of each of the extending members 101, 102 is inclined downward toward the support surface 91A.

As illustrated in FIG. 3, the front movable portion 110 is constituted by a portion of the front extending member 101. The rear movable portion 120 is constituted by a portion of the rear extending member 102. The front movable portion 110 and the rear movable portion 120 are mirror-image components having substantially the same construction, and illustration and explanation of the front movable portion 110 are partly omitted.

Figure 6:
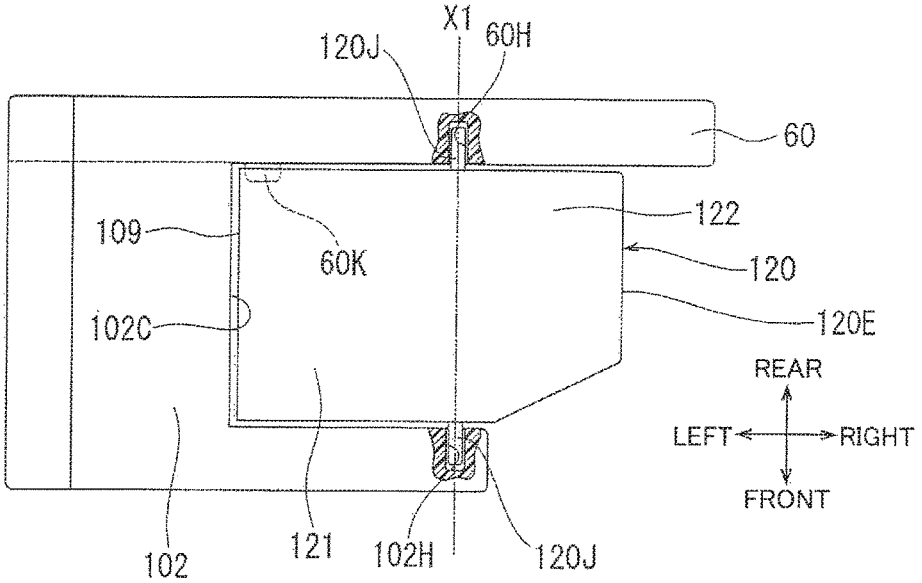
FIG. 6 is a top view of the image reading apparatus according to the first embodiment, illustrating a guide and a movable portion.
Figure 7:
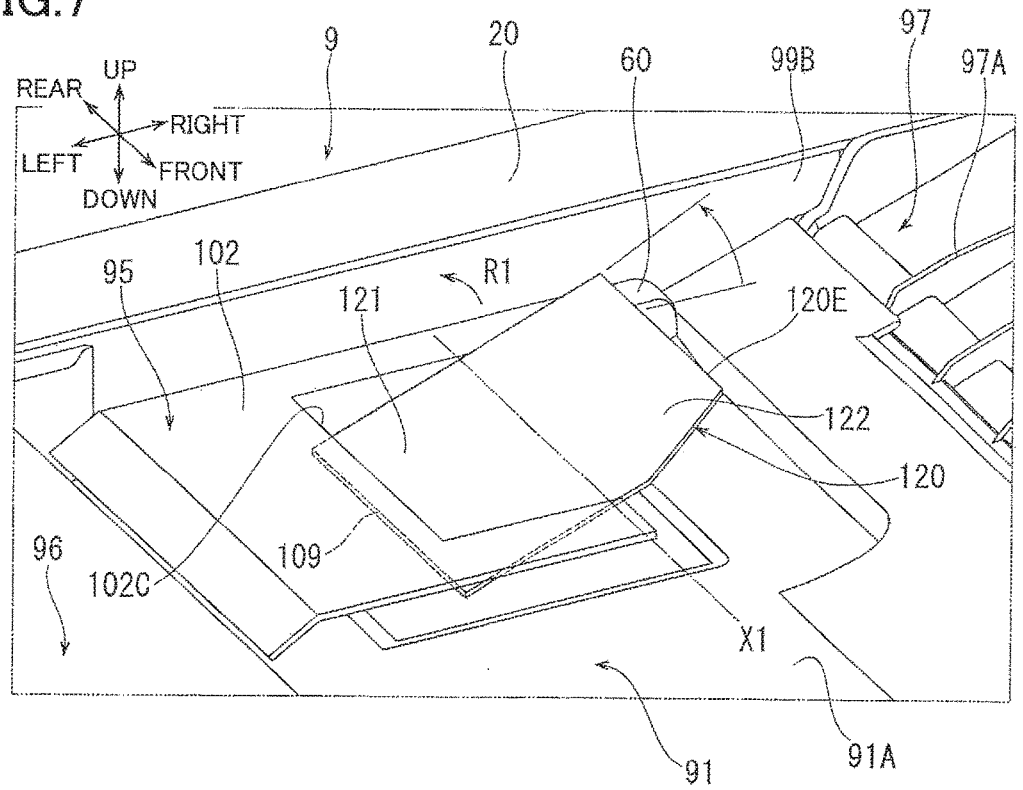
FIG. 7 is a partial perspective view of the image reading apparatus according to the first embodiment, mainly illustrating the guide and the movable portion.

Specifically, as illustrated in, e.g., FIGS. 6 and 7, the rear extending member 102 has a recess 102C and a support hole 102H. The recess 102C is formed by cutting out the rear extending member 102 from its right edge in the left direction such that the recess 102C has a substantially rectangular shape. The recess 102C is located adjacent to the rear guide 60. Since the recess 102C is formed, a front right corner portion of the rear extending member 102 is spaced apart from the rear guide 60. As illustrated in FIG. 6, the support hole 102H is recessed in the front right corner portion of the rear extending member 102 and defines a pivot axis X1 extending in the front and rear direction. A support hole 60H is recessed in the upper end portion of the rear guide 60 so as to define the pivot axis X1. The support hole 60H and the support hole 102H are formed in a pair. That is, the support hole 102H and the support hole 60H are located on the same straight line extending in the front and rear direction, with the same height in the up and down direction.

As illustrated in FIG. 3, a recess 101C similar to the recess 102C is formed in the front extending member 101. Though not illustrated, support holes similar to the respective support holes 60H, 102H are respectively formed in the front guide 60 and the extending member 101 to define the pivot axis X1.

As illustrated in, e.g., FIGS. 6 and 7, the rear movable portion 120 is a flat plate having a substantially rectangular shape with its front right corner portion cut off diagonally. As illustrated in FIG. 6, a pair of front and rear shafts 120J protrude from the rear movable portion 120. The front shaft 120J is inserted in the support hole 102H formed in the rear extending member 102, and the rear shaft 120J is inserted in the support hole 60H formed in the rear guide 60. With this insertion, as illustrated in FIGS. 3 and 5-9, the rear movable portion 120 is supported by the rear guide 60 and the rear extending member 102 so as to be pivotable or swingable about the pivot axis X1.

As illustrated in FIG. 3, the front movable portion 110 is a flat plate having a substantially rectangular shape with its rear right corner portion cut off diagonally. Though not illustrated, a pair of front and rear shafts protrude from the front movable portion 110 like the rear movable portion 120. These shafts are inserted in the respective support holes formed in the front guide 60 and the extending member 101. With this insertion, the front movable portion 110 is supported by the front guide 60 and the front extending member 101 so as to be pivotable (swingable) about the pivot axis X1.

As illustrated in, e.g., FIGS. 3, 6, and 7, the rear movable portion 120 includes a first portion 121 and a second portion 122. The first portion 121 is nearer to the conveyor 4 than the pivot axis X1, that is, the first portion 121 is located to the left of the pivot axis X1. The second portion 122 is farther from the conveyor 4 than the pivot axis X1, that is, the second portion 122 is located to the right of the pivot axis X1. The length of the first portion 121 in the right and left direction is longer than that of the second portion 122 in the right and left direction, whereby the first portion 121 is heavier than the second portion 122.

As illustrated in FIG. 3, the front movable portion 110 includes a first portion 111 and a second portion 112 like the rear movable portion 120. The first portion 111 is nearer to the conveyor 4 than the pivot axis X1, that is, the first portion 111 is located to the left of the pivot axis X1. The second portion 112 is farther from the conveyor 4 than the pivot axis X1, that is, the second portion 112 is located to the right of the pivot axis X1. The length of the first portion 111 in the right and left direction is longer than that of the second portion 112 in the right and left direction, whereby the first portion 111 is heavier than the second portion 112.

Figure 8:
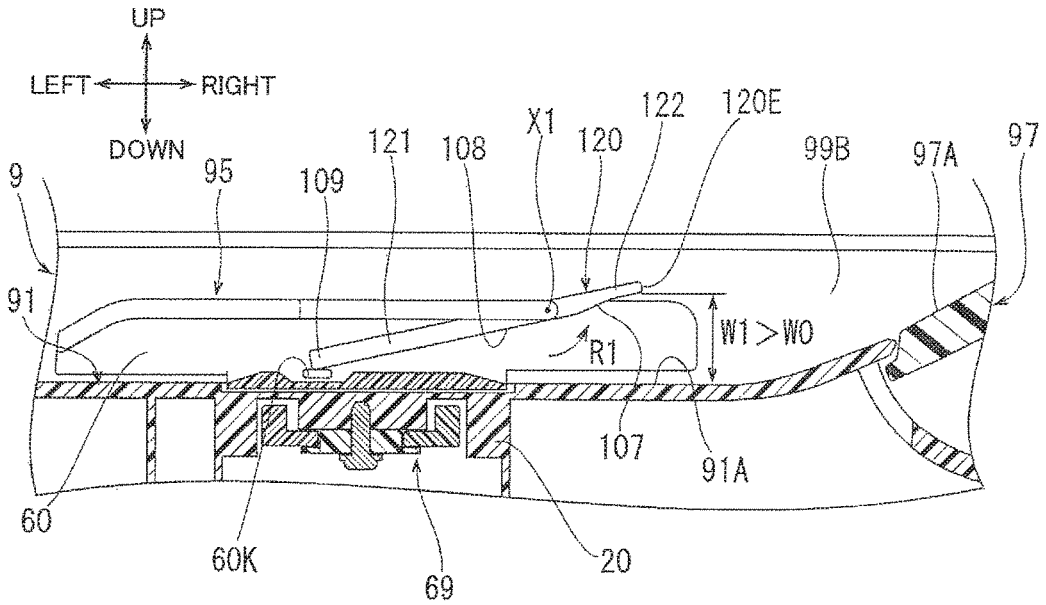
FIG. 8 is a partial cross-sectional view of the image reading apparatus according to the first embodiment, mainly illustrating the guide and the movable portion.

As illustrated in FIGS. 3 and 5-9, the second portion 122 of the rear movable portion 120 includes an opposed end portion 120E as one example of a particular end portion. The rear opposed end portion 120E is an end portion of the discharged-sheet supporter 95 which is farthest from the conveyor 4 and extends in the front and rear direction. Specifically, the rear opposed end portion 120E is an edge extending in the front and rear direction at a right end of the rear movable portion 120. As illustrated in FIGS. 5 and 8, the rear opposed end portion 120E located over the support surface 91A is opposed to the support surface 91A at the distance W1 therebetween. The rear movable portion 120 is pivotable about the pivot axis X1 in a direction R1 in which the distance W1 between the rear opposed end portion 120E and the support surface 91A is increased. In other words, the rear movable portion 120 is pivotable about the pivot axis X1 from a state in which the distance W1 is equal to the distance W0 as illustrated in FIG. 5 (W1=W0) to a state in which the distance W1 is greater than the distance W0 as illustrated in FIG. 8 (W1>W0).

As illustrated in FIG. 3, the second portion 112 of the front movable portion 110 includes an opposed end portion 110E as another example of the particular end portion. Like the rear opposed end portion 120E, the front opposed end portion 110E is an end portion of the discharged-sheet supporter 95 which is farthest from the conveyor 4 and extends in the front and rear direction. Specifically, the front opposed end portion 110E is an edge extending in the front and rear direction at a right end of the front movable portion 110. Like the rear opposed end portion 120E, though not illustrated, the front opposed end portion 110E located over the support surface 91A is opposed to the support surface 91A at the distance W1 therebetween. Like the rear movable portion 120, the front movable portion 110 is pivotable about the pivot axis X1 in the direction R1 in which the distance W1 between the front opposed end portion 110E and the support surface 91A is increased.

Since the first portions 111, 121 are heavier than the respective second portions 112, 122, as illustrated in FIG. 8, each of the movable portions 110, 120 is located at a first position in a standby state in which the conveyor 4 is not operated, and no sheet SH is supported on the support surface 91A. Also, each of the movable portions 110, 120 is positioned at the first position when each of the movable portions 110, 120 is pivoted such that a corresponding one of the second portions 112, 122 is moved in the direction R1 in which the distance W1 between the support surface 91A and a corresponding one of the opposed end portions 110E, 120E is increased and such that a corresponding one of the first portions 111, 121 is moved toward the support surface 91A of the supply-sheet supporter 91. FIGS. 7 and 9 also illustrate the state in which each of the movable portions 110, 120 is located at the first position.

As illustrated in, e.g., FIGS. 5 and 6, each of the front and rear guides 60 is provided with a limiter 60K. The limiter 60K is provided on a lower portion of the guide 60 so as to protrude toward the center of the support surface 91A in the front and rear direction from a position not interfering with the sheet SH supported by the support surface 91A. In the state in which each of the movable portions 110, 120 is located at the first position illustrated in, e.g., FIG. 8, an upper portion of the corresponding limiter 60K is in contact with a corner portion of a left end of the corresponding one of the first portions 111, 121. This contact limits an amount of pivotal movement of each of the movable portions 110, 120 to the first position. In the present embodiment, the limiter 60K prevents a left end of the corresponding one of the first portions 111, 121 from being located below the support surface 91A in the state in which each of the movable portions 110, 120 is located at the first position illustrated in, e.g., FIG. 8. Accordingly, the guides 60 are not slid even in the case where each of the movable portions 110, 120 is located at the first position.

As illustrated in FIGS. 3 and 5-9, a left edge portion of each of the first portions 111, 121 of the respective movable portions 110, 120 serves as a contact portion 109 extending in the front and rear direction. As illustrated in FIG. 9, when the sheet or sheets SH supported on the supply-sheet supporter 91 are inserted toward a supply roller 15 illustrated in FIG. 4, the sheets SH are brought into contact with the contact portions 109 to move the contact portions 109 upward. This movement of the contact portions 109 cause pivotal movement of each of the movable portions 110, 120 toward a second position at which the first portions 111, 121 are farther from the support surface 91A than at the first position, that is, each of the movable portions 110, 120 is pivoted in a direction reverse to the direction R1. FIG. 5 illustrates the movable portion 120 located at the second position.

As illustrated in, e.g., FIG. 5, each of the movable portions 110, 120 has a facing surface 108. The facing surface 108 is a surface of each of the first portions 111, 121 and the second portions 112, 122. The facing surface 108 faces downward and is opposed to the support surface 91A. The facing surface 108 has an inclined surface 107 near a corresponding one of the opposed end portions 110E, 120E. The inclined surface 107 is gently inclined toward the support surface 91A with decrease in distance to the conveyor 4, that is, the inclined surface 107 is inclined so as to be lower at its left portion than at its right portion.

As illustrated in FIG. 4, the body 20 has an inclined surface 20B, a cutout 20C, and a lower curved guide surface 20D, and is provided with a pressing-member supporter 29. The inclined surface 20B is located to the left of the support surface 91A and continues from the support surface 91A. The inclined surface 20B is inclined so as to be lower at its left portion than at its right portion. The cutout 20C is located to the left of the inclined surface 20B and shaped like a rectangular shape elongated in the front and rear direction. The lower curved guide surface 20D is located to the left of the cutout 20C and curved leftward and upward. The pressing-member supporter 29 is elongated over the cutout 20C in the front and rear direction.

A pressing member 39 is provided under the pressing-member supporter 29. The pressing member 39 is supported by the pressing-member supporter 29 so as to be movable in the up and down direction. A compression coil spring 38 is provided between the pressing-member supporter 29 and the pressing member 39. In the state in which the opening and closing member 9 is closed, the pressing member 39 is opposed to the reading surface 42A of the second platen glass 42 via the cutout 20C. The compression coil spring 38 urges the pressing member 39 toward the reading surface 42A.

The guide member 70 is located to the left of left ends of the respective guides 60. The guide member 70 is spaced apart from and located over a left portion of the support surface 91A, the inclined surface 20B, the cutout 20C, and the pressing-member supporter 29. The guide member 70 extends in the front and rear direction and the right and left direction. Though not illustrated, a front end portion and a rear end portion of the guide member 70 are fixed to the body 20, whereby the guide member 70 is assembled to the body 20 in a state in which the guide member 70 extends over the left portion of the support surface 91A in the front and rear direction.

As illustrated in FIGS. 4 and 5, the guide surface 70G is an upper surface of the guide member 70 which extends substantially horizontally. The guide surface 70G is located to the left of the extending members 101, 102, and a right end of the guide surface 70G is located near the extending members 101, 102. The discharged-sheet supporter 95 is constituted by the guide surface 70G of the guide member 70, the extending members 101, 102, and the movable portions 110, 120. The discharged-sheet supporter 95 is located above the supply-sheet supporter 91. As illustrated in FIGS. 2 and 9, the sheet SH conveyed by the conveyor 4 is discharged onto the discharged-sheet supporter 95 after an image on the sheet SH is read by the reading sensor 3S.

As illustrated in FIG. 4, a portion of the first cover 96 which is opposed to the discharge roller 12 has an upper curved guide surface 96D. The upper curved guide surface 96D is connected to the lower curved guide surface 20D of the body 20 and curved upward and rightward.

The body 20, the guide member 70, and the first cover 96 define the conveyance path P1 illustrated in FIGS. 2 and 4. Specifically, the conveyance path P1 has a lower path PB1, a curved path PC1, and an upper path PAL As illustrated in FIG. 4, the lower path PB1 is inclined from the support surface 91A along the inclined surface 20B so as to be lower at a left portion of the lower path PB1 than at its right portion. The lower path PB1 extends over the reading surface 42A of the second platen glass 42. The lower path PB1 is also defined from above by (i) a lower surface of the guide member 70, (ii) ribs extending downward from the lower surface of the guide member 70, and (iii) a lower surface of the pressing member 39, and other components. On the lower path PB1, the sheet SH is conveyed in the left direction.

The curved path PC1 is connected to the lower path PB1. The curved path PC1 makes an upward U-turn along the lower curved guide surface 20D of the body 20 and the upper curved guide surface 96D of the first cover 96, then extends rightward, and finally is connected to the upper path PA1.

The lower curved guide surface 20D and the upper curved guide surface 96D define the curved path PC1 from an outer side thereof. An outer circumferential surface of the discharge roller 12 defines the curved path PC1 from an inner side thereof. The outer side of the curved path PC1 is located remote from the outer circumferential surface of the discharge roller 12 in a radially outward direction. The inner side of the curved path PC1 is located nearer to the axis of the discharge roller 12 than the outer side.

The upper path PA1 is defined from below by the guide surface 70G of the guide member 70 so as to extend rightward to an area over the extending members 101, 102 and the movable portions 110, 120. The cover guide surface 96G of the first cover 96 faces the guide surface 70G, with the conveyance path P1 interposed therebetween, that is, the cover guide surface 96G defines the upper path PA1 from above. The cover guide surface 96G and the guide surface 70G guide the sheet SH toward the upper surfaces of the extending members 101, 102 and the movable portions 110, 120 while contacting the sheet SH being conveyed.

In view of the above, the conveyance path P1 guides the sheet SH from the supply-sheet supporter 91 to the reading sensor 3S and then to the discharged-sheet supporter 95. In the present embodiment, the widthwise direction orthogonal to the direction in which the sheet SH is conveyed coincides with the front and rear direction.

The conveyor 4 includes the supply roller 15, a separating roller 16, and a separating pad 16A. The supply roller 15 and the separating roller 16 are rotatably supported by the body 20. Upper portions of the supply roller 15 and the separating roller 16 are exposed from the left portion of the support surface 91A of the body 20. The separating roller 16 is located on the lower path PB1 of the conveyance path P1 at a position located downstream of the supply roller 15 in the sheet conveying direction.

The separating pad 16A is located over the separating roller 16, with the lower path PB1 interposed therebetween. The separating pad 16A is movably supported by the guide member 70 so as to be pressed against the separating roller 16.

The supply roller 15 and the separating roller 16 are rotated while contacting the lower surface of the sheet SH supported by the support surface 91A to supply the sheet SH to the lower path PB1 of the conveyance path P1. During this supply, the separating roller 16 and the separating pad 16A separate the sheet SH to be conveyed, from the other sheet or sheets SH stacked on the sheet SH.

The conveyor 4 includes a conveying roller 11, first pinch rollers 11P, the discharge roller 12, second pinch rollers 12P, and discharge pinch rollers 13.

The conveying roller 11 is rotatably supported by the guide member 70 and located above the inclined surface 20B so as to be opposed to the inclined surface 20B. The first pinch rollers 11P are rotatably supported by the body 20. Upper portions of the respective first pinch rollers 11P are exposed from the inclined surface 20B. The first pinch rollers 11P are pressed against the conveying roller 11.

The discharge roller 12 is located to the right of the lower curved guide surface 20D and the upper curved guide surface 96D and rotatably supported by the body 20. The outer circumferential surface of the discharge roller 12 is located above and to the right of the lower curved guide surface 20D so as to be opposed to the lower curved guide surface 20D, with the curved path PC1 of the conveyance path P1 interposed therebetween. The outer circumferential surface of the discharge roller 12 is located below and to the right of the upper curved guide surface 96D of the first cover 96 so as to be opposed to the upper curved guide surface 96D, with the curved path PC1 of the conveyance path P1 interposed therebetween.

The second pinch rollers 12P are rotatably supported by the body 20, and upper portions of the respective second pinch rollers 12P are exposed from the lower curved guide surface 20D. The second pinch rollers 12P are pressed against the discharge roller 12.

The discharge pinch rollers 13 are rotatably supported near the upper curved guide surface 96D of the first cover 96 and pressed against the discharge roller 12.

The sheet SH supplied to the conveyance path P1 by the supply roller 15 and the separating roller 16 is conveyed toward the cutout 20C by the conveying roller 11 and the first pinch rollers 11P such that the sheet SH is then conveyed through an area between the reading surface 42A of the second platen glass 42 and the lower surface of the pressing member 39, that is, the sheet SH is conveyed through an area over the reading sensor 3S located at the stationary reading position.

After passing through the area over the reading sensor 3S, the sheet SH is conveyed by the discharge roller 12, the second pinch rollers 12P, and the discharge pinch rollers 13 so as to make an upward U-turn along the curved path PC1. During conveyance of the sheet SH along the curved path PC1, the lower curved guide surface 20D and the upper curved guide surface 96D contact the sheet SH from an outer side of the curved path PC1 to guide the sheet SH in a curved shape. After the sheet SH passes through the curved path PC1, the discharge roller 12 and the discharge pinch rollers 13 convey the sheet SH along the upper path PA1 and discharge the sheet SH onto the discharged-sheet supporter 95. In other words, the sheet SH is discharged onto the guide surface 70G, the extending members 101, 102, and the movable portions 110, 120 as the discharged-sheet supporter 95. That is, the guide surface 70G guides and supports the sheet SH.

Image Reading

To read an image formed on the document supported on the document support surface 41A in this image reading apparatus 1, the scanning mechanism, not illustrated, is operated in the reading unit 3 to move the reading sensor 3S in the right and left direction from a position under a left edge of the document support surface 41A to a position under a right edge of the document support surface 41A. During this movement, the reading sensor 3S reads the image formed on the document supported on the document support surface 41A. Upon completion of the reading, the scanning mechanism, not illustrated, moves the reading sensor 3S from a right end to a left end in the reading unit 3 to move the reading sensor 3S back to its original position.

To read images formed on the respective sheets SH supported on the support surface 91A of the supply-sheet supporter 91 in this image reading apparatus 1, as illustrated in FIG. 9, the user first sets the sheets SH on the support surface 91A. In this operation, while being slid on the support surface 91A, leading ends of the respective sheets SH are inserted through an area under the extending members 101, 102 and the movable portions 110, 120 so as to come into contact with the supply roller 15 illustrated in FIG. 4. In this state, each of the movable portions 110, 120 is located at the first position, and the distance W1 between the support surface 91A and each of the opposed end portions 110E, 120E of the respective movable portions 110, 120 is greater than the distance W0, making difficult for the leading ends of the respective sheets SH to be caught by the opposed end portions 110E, 120E, enabling smooth insertion of the sheets SH. Also, the leading ends of the respective sheets SH are inserted to a position near the supply roller 15 while being in contact with the contact portions 109 and pushing the contact portions 109 upward. That is, when the sheets SH are set on the supply-sheet supporter 91, each of the movable portions 110, 120 is pivoted to the second position illustrated in FIG. 5.

The scanning mechanism, not illustrated, is then operated in the reading unit 3 to move the reading sensor 3S to the stationary reading position under the reading surface 42A. When the sheets SH supported on the support surface 91A and the subsidiary support surface 97A are conveyed one by one along the conveyance path P1 by the conveyor 4, the reading sensor 3S reads an image on each sheet SH conveyed over the reading sensor 3S located at the stationary reading position while contacting the reading surface 42A. Each sheet SH with the image read by the reading sensor 3S is conveyed by the conveyor 4 so as to be discharged onto the guide surface 70G, the extending members 101, 102, and the movable portions 110, 120 as the discharged-sheet supporter 95.

In this operation, as illustrated in FIG. 9, the leading ends of the respective sheets SH supported on the support surface 91A push the contact portions 109 upward, whereby each of the movable portions 110, 120 is pivoted toward the second position at which each of the first portions 111, 121 is located farther from the support surface 91A than at the first position, that is, each of the movable portions 110, 120 is pivoted in the direction reverse to the direction R1. The weight of the sheets SH discharged on the second portions 112, 122 of the respective movable portions 110, 120 also causes pivotal movement of the movable portions 110, 120 in the direction reverse to the direction R1. This construction makes it difficult for the second portions 112, 122 of the respective movable portions 110, 120 to hinder the sheet SH from being discharged onto the discharged-sheet supporter 95.

Effects

In the image reading apparatus 1 according to the first embodiment, each of the movable portions 110, 120 is constructed such that the corresponding one of the first portions 111, 121 is heavier than the corresponding one of the second portions 112, 122. Thus, as illustrated in FIG. 9, when the user sets the sheet or sheets SH on the supply-sheet supporter 91, each of the movable portions 110, 120 has been pivoted in the direction R1 in which the distance W1 between each of the opposed end portions 110E, 120E and the support surface 91A of the supply-sheet supporter 91 is increased, that is, each of the movable portions 110, 120 is located at the first position. At this first position, each of the opposed end portions 110E, 120E of the respective movable portions 110, 120 is farther from the support surface 91A than at the second position. This state makes it difficult for the opposed end portions 110E, 120E to catch the sheets SH inserted by the user into the area between the support surface 91A of the supply-sheet supporter 91 and each of the opposed end portions 110E, 120E. On the other hand, pivotal movement of the movable portions 110, 120 may be prevented in the state in which the user does not set the sheet SH onto the supply-sheet supporter 91. For example, the second portions 112, 122 of the respective movable portions 110, 120 may be in contact with the second cover 97 located at the covering position to limit pivotal movement of the movable portions 110, 120 in the direction R1 in the state in which the distance W1 is equal to the distance W0. This construction prevents increase in the distance W1 between each of the opposed end portions 110E, 120E of the discharged-sheet supporter 95 and the support surface 91A of the supply-sheet supporter 91, resulting in smaller size of the opening and closing member 9 in the up and down direction.

Accordingly, it is possible to reduce the size of the image reading apparatus 1 according to the first embodiment in the up and down direction and facilitate the operation of setting the sheets SH onto the support surface 91A of the supply-sheet supporter 91.

In the image reading apparatus 1, as illustrated in, e.g., FIGS. 6 and 7, the movable portions 110, 120 are constituted by the portions of the respective extending members 101, 102 connected to the upper end portions of the respective guides 60. Also, the movable portions 110, 120 are supported by the respective extending members 101, 102 and the respective guides 60 pivotably about the pivot axis X1. This construction simplifies constructions of the movable portions 110, 120 and components near the movable portions 110, 120, resulting in reduced manufacturing cost.

In this image reading apparatus 1, the opposed end portions 110E, 120E of the discharged-sheet supporter 95 are moved upward away from front and rear portions of the support surface 91A, facilitating the operation of setting the sheets SH onto the support surface 91A.

In this image reading apparatus 1, as illustrated in, e.g., FIG. 3, the movable portions 110, 120 include the respective first portions 111, 121 and the respective second portions 112, 122. As illustrated in FIG. 9, when the sheets SH are set on the supply-sheet supporter 91, the contact portions 109 of the respective first portions 111, 121 are pushed upward by the sheets SH, causing pivotal movement of each of the movable portions 110, 120 from the first position illustrated in FIG. 9 to the second position illustrated in FIG. 5. In this operation, the movable portions 110, 120 are pivoted such that the second portions 112, 122 integrally with the respective first portions 111, 121 move in the direction reverse to the direction R1 in which the distance W1 between each of the opposed end portions 110E, 120E of the discharged-sheet supporter 95 and the support surface 91A of the supply-sheet supporter 91 is increased, making it difficult for the second portions 112, 122 of the respective movable portions 110, 120 to hinder the sheet SH from being discharged onto the discharged-sheet supporter 95.

In this image reading apparatus 1, the first portions 111, 121 are heavier than the respective second portions 112, 122. With this construction, in the standby state in which the conveyor 4 is not operated, and no sheet SH is supported on the support surface 91A, as illustrated in, e.g., FIG. 8, the movable portions 110, 120 are pivoted by their respective weights such that the second portions 112, 122 move in the direction R1 in which the distance W1 between each of the opposed end portions 110E, 120E of the discharged-sheet supporter 95 and the support surface 91A of the supply-sheet supporter 91 is increased, so that each of the movable portions 110, 120 is positioned at the first position at which each of the first portions 111, 121 is located at the lower position. Also, as illustrated in FIG. 9, when the sheet SH to be discharged is conveyed over the second portions 112, 122 of the respective movable portions 110, 120, the weight of the sheet SH causes pivotal movement of the movable portions 110, 120 such that the respective second portions 112, 122 move in the direction reverse to the direction R1 in which the distance W1 between each of the opposed end portions 110E, 120E of the discharged-sheet supporter 95 and the support surface 91A of the supply-sheet supporter 91 is increased, making it difficult for the second portions 112, 122 of the respective movable portions 110, 120 to hinder the sheet SH from being discharged onto the discharged-sheet supporter 95. This construction further simplifies constructions of the movable portions 110, 120 and components near the movable portions 110, 120, resulting in reduced manufacturing cost.

In this image reading apparatus 1, as illustrated in, e.g., FIGS. 6 and 8, the limiters 60K contact the respective movable portions 110, 120 to limit the amount of pivotal movement of each of the movable portions 110, 120 to the first position. This limitation can keep a relative relationship between the support surface 91A and each of the contact portions 109 of the respective first portions 111, 121, within a preferable range. Also, the limiters 60K prevent the contact portions 109 of the respective first portions 111, 121 from being situated below the support surface 91A and interfering the respective guides 60, thereby preventing a malfunction in which sliding of the guides 60 in the front and rear direction is hindered due to interference of the contact portions 109 with the respective guides 60.

In this image reading apparatus 1, as illustrated in, e.g., FIG. 5, the inclined surfaces 107 inclined toward the supply-sheet supporter 91 with decrease in distance to the conveyor 4 are respectively formed near the opposed end portions 110E, 120E of the facing surfaces 108 of the respective movable portions 110, 120. As illustrated in FIG. 9, the inclined surfaces 107 make it difficult for the sheets SH to be caught by the facing surfaces 108 of the respective movable portions 110, 120 during the operation of setting the sheets SH onto the supply-sheet supporter 91.

In this image reading apparatus 1, as illustrated in, e.g., FIGS. 3 and 9, the second cover 97 located at the support position helps the supply-sheet supporter 91 and the discharged-sheet supporter 95 to support the sheets SH, thereby well supporting the conveyed and discharged sheets SH.

In this image reading apparatus 1, the second cover 97 is movable between the covering position at which the second cover 97 covers the discharged-sheet supporter 95 as illustrated in FIG. 1 and the support position at which the second cover 97 supports the sheet SH as illustrated in, e.g., FIG. 3. With this construction, in the case where the image reading apparatus 1 is not used, the second cover 97 may be moved to the covering position to cover the discharged-sheet supporter 95 from above. In this movement, the movable portions 110, 120 are pivoted in the direction reverse to the direction R1 in which the distance W1 between each of the opposed end portions 110E, 120E of the discharged-sheet supporter 95 and the support surface 91A of the supply-sheet supporter 91 is increased, that is, each of the movable portions 110, 120 is pivoted to the second position illustrated in FIG. 5, whereby the second cover 97 located at the covering position is located near the support surface 91A. This enables reduction in size of the image reading apparatus 1 in the up and down direction in the state in which the image reading apparatus 1 is not used.

Second Embodiment

In an image reading apparatus according to a second embodiment, as illustrated in FIGS. 10-14, the movable portions 110, 120 provided in the first embodiment are not provided on the respective extending members 101, 102.

Also, the recesses 101C, 102C formed in the first embodiment are not formed in the respective extending members 101, 102. Instead of the movable portions 110, 120 provided in the first embodiment, the image reading apparatus according to the second embodiment includes a plate member 210 having a substantially rectangular shape elongated in the front and rear direction. The plate member 210 is another example of the movable member. In the image reading apparatus according to the second embodiment, the discharged-sheet supporter 95 is constituted by the guide surface 70G, the extending members 101, 102, and the plate member 210.

Figure 10:
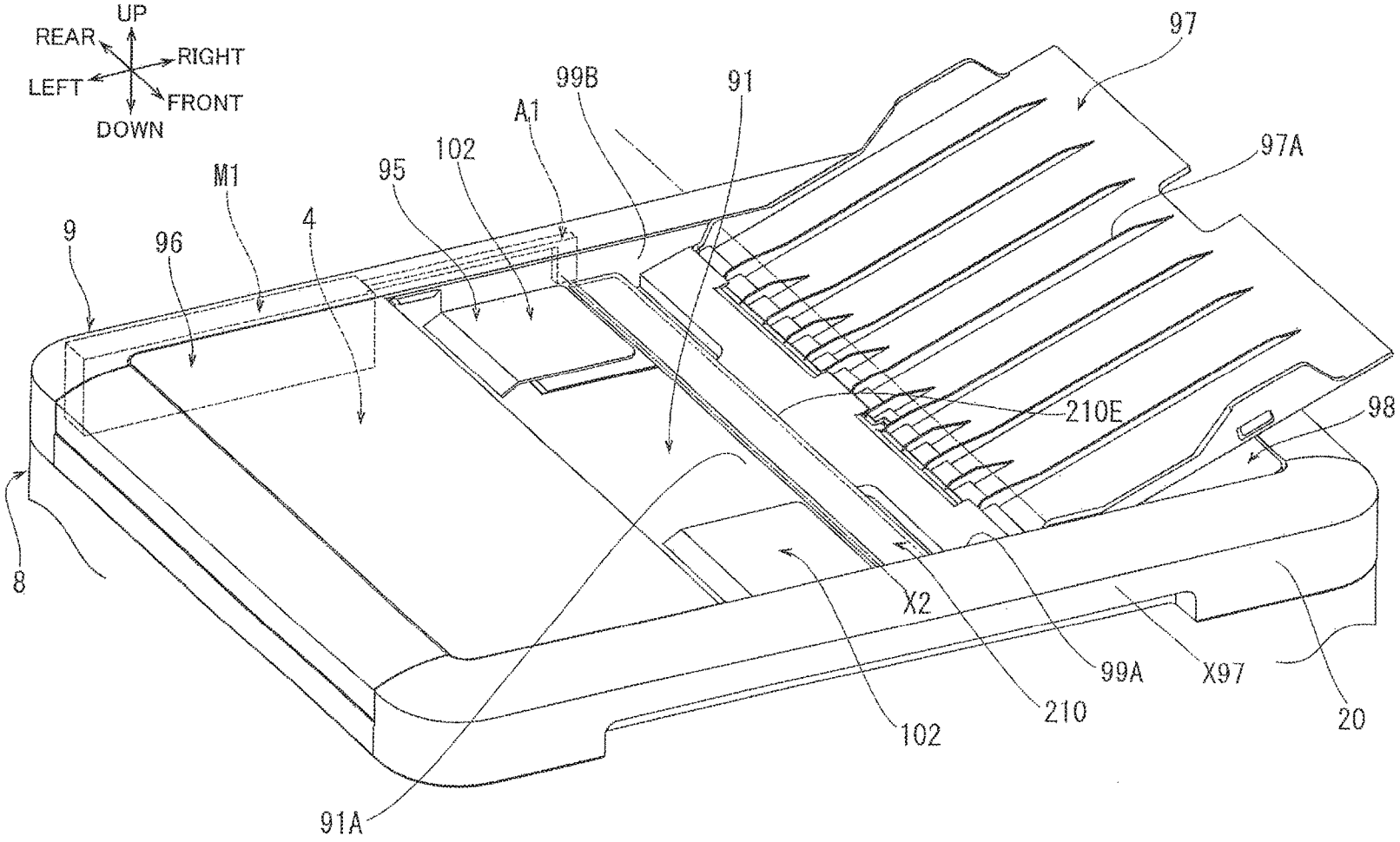
FIG. 10 is a partial perspective view of an image reading apparatus according to a second embodiment, illustrating a state in which a sub-tray is opened.

As illustrated in FIG. 10, the body 20 includes a pair of side walls 99A, 99B in the image reading apparatus according to the second embodiment. The side walls 99A, 99B are opposed to each other, with the support surface 91A of the supply-sheet supporter 91 being interposed between the side walls 99A, 99B in the front and rear direction.

As illustrated in FIGS. 10-14, the plate member 210 is supported at its left portion by the side walls 99A, 99B so as to be pivotable about a pivot axis X2 extending in the front and rear direction. The pivot axis X2 is located near and to the right of right end portions of the respective extending members 101, 102.

The plate member 210 includes an opposed end portion 210E. The opposed end portion 210E is located furthest from the conveyor 4 in the discharged-sheet supporter 95 so as to extend in the front and rear direction. Specifically, the opposed end portion 210E is a right edge of the plate member 210 which extends in the front and rear direction.

Figure 11:
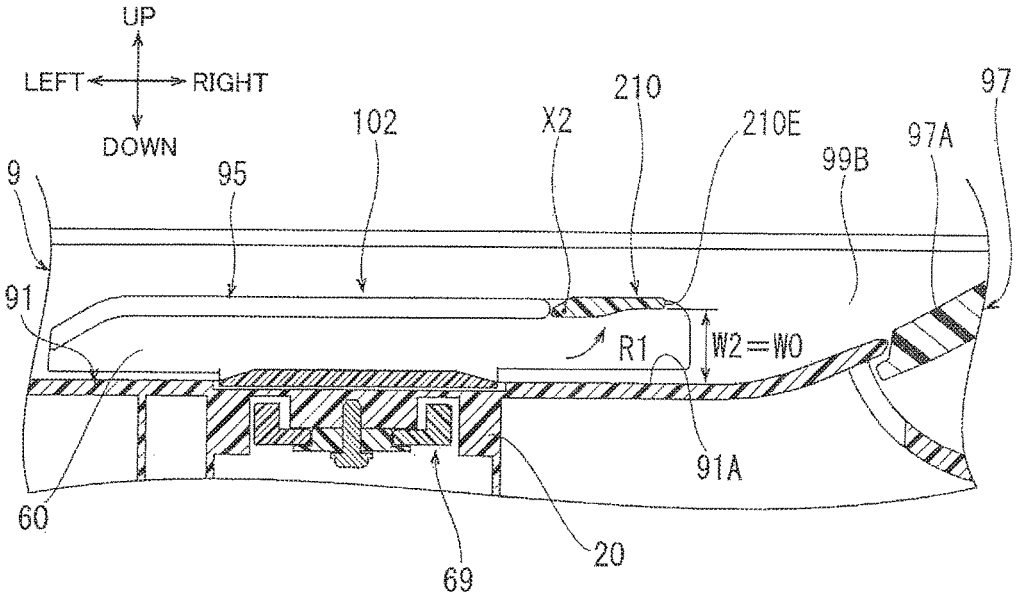
FIG. 11 is a partial cross-sectional view of the image reading apparatus according to the second embodiment, mainly illustrating the guide and the movable portion.
Figure 13:
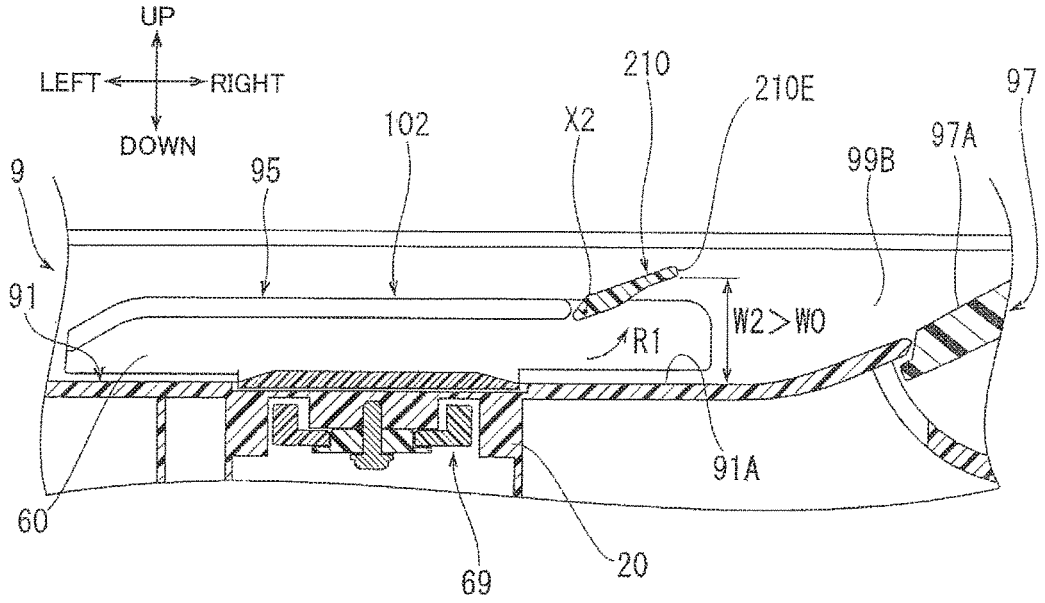
FIG. 13 is a partial cross-sectional view of the image reading apparatus according to the second embodiment, mainly illustrating the guide and the movable portion.

As illustrated in FIG. 11, the opposed end portion 210E is located above the support surface 91A so as to be opposed to the support surface 91A at a distance W2 therebetween. The plate member 210 is pivotable in the direction R1 in which the distance W2 between the opposed end portion 210E and the support surface 91A is increased. In other words, the plate member 210 is pivotable so as to change a state of the plate member 210 from a state in which the distance W2 is equal to the distance W0 (W2=W0) as illustrated in FIG. 11 to a state in which the distance W2 is greater than the distance W0 (W2>W0) as illustrated in FIG. 13.

Figure 12:
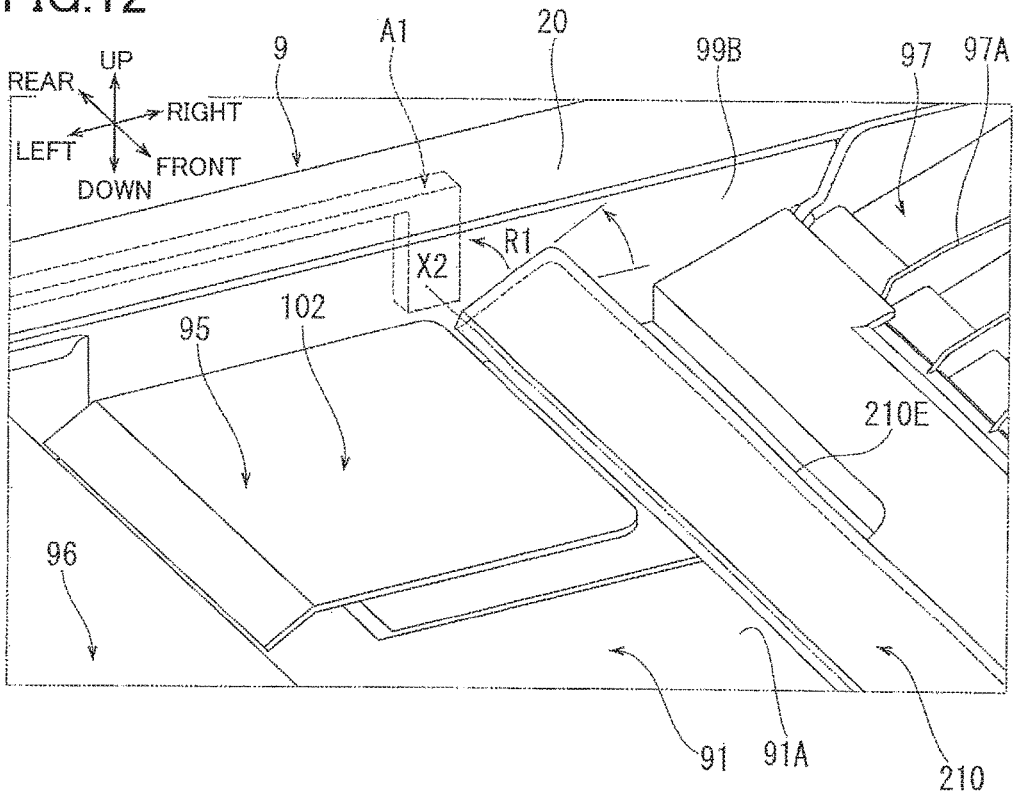
FIG. 12 is a partial perspective view of the image reading apparatus according to the second embodiment, mainly illustrating the guide and the movable portion.

As illustrated in FIGS. 10 and 12, the opening and closing member 9 is provided with an actuator A1. In the present embodiment, the actuator A1 includes a plurality of gear groups, intermittent gears, and an urging spring, not illustrated, which are combined with each other.

Figure 14:
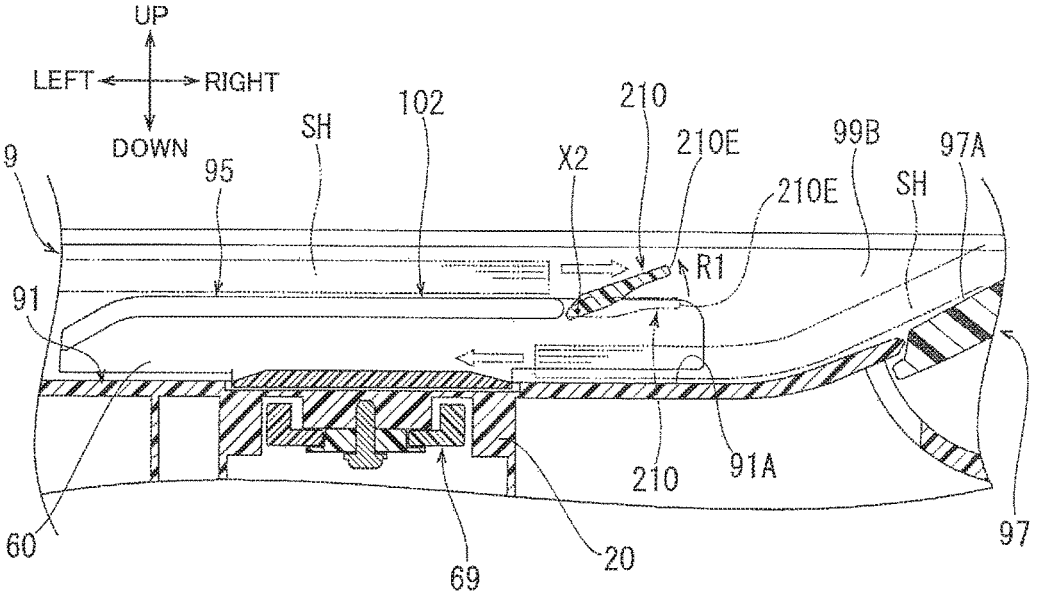
FIG. 14 is a partial cross-sectional view of the image reading apparatus according to the second embodiment, for explaining operations of the movable portion.

During stop of the conveyor 4, the actuator A1 isolates the plate member 210 and a drive source M1 for driving the conveyor 4 from each other to allow pivotal movement of the plate member 210. In this state, as illustrated in FIGS. 12-14, the plate member 210 is pivoted in the direction R1 about the pivot axis X2 by an urging force of the urging spring, not illustrated, of the actuator A1. During operation of the conveyor 4, on the other hand, the actuator A1 intermittently transmits a driving force from the drive source M1 to the plate member 210 to, as illustrated in FIGS. 10 and 11, cause pivotal movement of the plate member 210 about the pivot axis X2 in the direction reverse to the direction R1. It is noted that the actuator A1 may be a device operated independently of the drive source M1, such as a solenoid and a motor, for example.

The other construction in the second embodiment is the same as that in the first embodiment. Thus, the same reference numerals as used in the first embodiment are used to designate the corresponding elements of the second embodiment, and an explanation of which is dispensed with.

In the image reading apparatus according to the second embodiment, as illustrated in FIGS. 12-14, the plate member 210 is pivoted by the urging spring, not illustrated, of the actuator A1 during stop of the conveyor 4 in the direction R1 in which the distance W2 between the opposed end portion 210E and the support surface 91A is increased, facilitating the operation of setting the sheets SH onto the supply-sheet supporter 91.

In this image reading apparatus, as illustrated in FIGS. 10 and 11, the driving force generated by the drive source M1 is transmitted to the plate member 210 by the actuator A1 during operation of the conveyor 4 to cause pivotal movement of the plate member 210 in the direction reverse to the direction R1 in which the distance W2 between the opposed end portion 210E and the support surface 91A is increased. As indicated by the two-dot chain lines in FIG. 14, the plate member 210 does not hinder discharge of the sheet SH onto the discharged-sheet supporter 95.

In this image reading apparatus, the plate member 210 is pivoted by the actuator A1 in the direction reverse to the direction R1 in which the distance W2 between the opposed end portion 210E and the support surface 91A is increased, and then the second cover 97 is moved to the covering position after the image reading apparatus 1 is stopped, resulting in smaller size of the opening and closing member 9 in the up and down direction.

Accordingly, it is possible to reduce the size of the image reading apparatus 1 according to the second embodiment in the up and down direction and facilitate the operation of setting the sheets SH onto the support surface 91A of the supply-sheet supporter 91 as in the image reading apparatus 1 according to the first embodiment.

While the first and second embodiments have been described above, it is to be understood that the disclosure is not limited to the details of the illustrated embodiments, but may be embodied with various changes and modifications, which may occur to those skilled in the art, without departing from the spirit and scope of the disclosure.

For example, the movable member may be constituted by the entire extending member and supported by the guide pivotably about the pivot axis. The second cover 97 according to the first embodiment may be replaced with a fixed tray as another example of the second discharged-sheet supporter. In this construction, the movable member may be always located at the first position in a state in which no sheets are placed on the supply-sheet supporter. This construction enables the user to set the sheets onto the supply-sheet supporter without opening the second cover.

The present disclosure may be applied not only to the image reading apparatuses but also to image forming apparatuses and multi-function peripherals, for example.

What is claimed is:

1. A sheet conveyance apparatus, comprising:

a supply-sheet supporter comprising a supply support surface that supports a sheet;

a conveyor configured to convey the sheet from the supply-sheet supporter along a conveyance path; and a discharged-sheet supporter disposed above the supply-sheet supporter and configured to support the sheet conveyed by the conveyor, the discharged-sheet supporter comprising:

a particular end portion located farthest from the conveyor in the discharged-sheet supporter; and a movable member comprising the particular end portion at one of opposite end portions of the movable member, which one is farther from the conveyor than another of the opposite end portions, the particular end portion being movable so as to increase a distance between the particular end portion and the supply support surface, wherein the movable member is pivotable about a pivot axis such that the particular end portion is positioned at (i) an upper position at which the distance between the particular end portion and the supply support surface is a first distance and (ii) a lower position at which the distance between the particular end portion and the supply support surface is a second distance that is less than the first distance, and wherein the particular end portion is configured to be positioned at the upper position when an upper surface of the movable member does not contact the sheet supported by the discharged-sheet supporter and is configured to be moved, by weight of the sheet, from the upper position toward the lower position when the upper surface of the movable member contacts the sheet supported by the discharged-sheet supporter.

2. The sheet conveyance apparatus according to claim 1, wherein the movable member is pivotable in a direction in which the distance between the particular end portion and the supply support surface is increased.

3. The sheet conveyance apparatus according to claim 2, further comprising:

a wall protruding upward from the supply support surface of the supply-sheet supporter; and an extending member connected to an upper end portion of the wall, the extending member extending toward a central portion of the sheet conveyance apparatus in a widthwise direction, the extending member being configured to support the sheet as at least a portion of the discharged-sheet supporter, wherein at least a portion of the movable member constitutes at least a portion of the extending member, and wherein the movable member is supported by one of the extending member and the wall so as to be pivotable about the pivot axis parallel with the widthwise direction.

4. The sheet conveyance apparatus according to claim 3, wherein the wall is a guide configured to guide an edge of the sheet in the widthwise direction orthogonal to a conveying direction in which conveyor conveys the sheet.

5. The sheet conveyance apparatus according to claim 3, wherein the wall is movable in the widthwise direction orthogonal to a conveying direction in which conveyor conveys the sheet.

6. The sheet conveyance apparatus according to claim 3, further comprising:

two walls each as the wall; and two extending members each as the extending member, wherein the two walls are respectively provided on opposite end portions of the supply support surface of the supply-sheet supporter in the widthwise direction, wherein the two extending members are respectively provided above the opposite end portions of the supply support surface, and wherein at least a portion of the movable member constitutes at least a portion of the two extending members.

7. The sheet conveyance apparatus according to claim 2, further comprising a pair of side walls respectively provided on opposite sides of the supply support surface of the supply-sheet supporter in a widthwise direction orthogonal to a conveying direction in which the conveyor conveys the sheet, wherein the movable member is a plate member extending in the widthwise direction, and wherein the movable member is supported by at least one of the pair of side walls so as to be pivotable about the pivot axis parallel with the widthwise direction.

8. The sheet conveyance apparatus according to claim 2, further comprising an actuator configured to pivot the movable member, wherein the actuator is configured to:

pivot the movable member in the direction in which the distance between the particular end portion and the supply support surface is increased, when the conveyor is stopped from conveying the sheet; and pivot the movable member in a direction in which the distance is reduced, when the conveyor conveys the sheet.

9. The sheet conveyance apparatus according to claim 2, wherein the movable member comprises:

a first portion located nearer to the conveyor than the pivot axis of the movable member; and a second portion located farther from the conveyor than the pivot axis and comprising the particular end portion, wherein before the sheet is supported by the supply support surface, the movable member is located at a first position to which the movable member is pivoted by moving the second portion in the direction in which a distance between the second portion and the supply support surface is increased and by moving the first portion in a direction in which a distance between the first portion and the supply support surface is reduced, and wherein the first portion of the movable member comprises a contact portion that contacts the sheet supported by the supply support surface, to pivot the movable member toward a second position, and a distance between the first portion and the supply support surface is greater when the movable member is located at the second position than when the movable member is located at the first position.

10. The sheet conveyance apparatus according to claim 9, wherein the first portion is heavier than the second portion.

11. The sheet conveyance apparatus according to claim 9, further comprising a limiter that contacts the movable member to limit an amount of pivotal movement of the movable member to the first position.

12. The sheet conveyance apparatus according to claim 1, wherein the movable member comprises a facing surface that faces the supply support surface of the supply-sheet supporter, and wherein a portion of the facing surface, which is located nearer to the particular end portion than a center of the facing surface, comprises an inclined surface extending such that a distance between the inclined surface and the supply-sheet supporter decreases with decrease in distance to the conveyor.

13. The sheet conveyance apparatus according to claim 1, wherein when the discharged-sheet supporter is defined as a first discharged-sheet supporter, the sheet conveyance apparatus further comprises a second discharged-sheet supporter provided farther from the conveyor than the supply-sheet supporter and the first discharged-sheet supporter, the second discharged-sheet supporter and the supply-sheet supporter being configured to support the sheet conveyed by the conveyor, the first discharged-sheet supporter and the second discharged-sheet supporter being configured to support the sheet discharged by the conveyor.

14. The sheet conveyance apparatus according to claim 13, wherein the second discharged-sheet supporter is movable between (i) a covering position at which the second discharged-sheet supporter covers the first discharged-sheet supporter from above and (ii) a support position at which the second discharged-sheet supporter is capable of supporting the sheet.

15. The sheet conveyance apparatus according to claim 1, further comprising a reader provided on the conveyance path and configured to read an image on the sheet conveyed by the conveyor.

* * * * *